US009358163B1

(12) United States Patent
Studebaker

(10) Patent No.: US 9,358,163 B1
(45) Date of Patent: Jun. 7, 2016

(54) DETACHABLE ELECTRIC DRIVE UNIT FOR A WHEELCHAIR

(71) Applicant: Charles E. Studebaker, Galloway, OH (US)

(72) Inventor: Charles E. Studebaker, Galloway, OH (US)

( * ) Notice: Subject to any disclaimer, the term of this patent is extended or adjusted under 35 U.S.C. 154(b) by 0 days.

(21) Appl. No.: 14/835,306

(22) Filed: Aug. 25, 2015

Related U.S. Application Data

(60) Provisional application No. 62/081,629, filed on Nov. 19, 2014.

(51) Int. Cl.
*A61G 5/04* (2013.01)

(52) U.S. Cl.
CPC ..... *A61G 5/047* (2013.01); *A61G 5/045* (2013.01)

(58) Field of Classification Search
CPC ..... A61G 5/047; A61G 5/048
See application file for complete search history.

(56) References Cited

U.S. PATENT DOCUMENTS 5,222,567 A 6/1993 Broadhead et al.
6,547,018 B1 * 4/2003 Choi ..... A61G 5/045 180/11
6,766,871 B2 * 7/2004 Sawyer ..... A61G 5/047 180/13
7,198,122 B1 * 4/2007 Smith ..... B62D 61/08 180/12
7,815,004 B1 * 10/2010 Watkins ..... A61G 3/06 180/198
8,388,010 B2 3/2013 Butts et al.
8,960,352 B2 * 2/2015 Avigad ..... A61G 5/104 180/198
9,072,641 B2 * 7/2015 Ewing ..... A61G 3/0808
2008/0223649 A1 * 9/2008 Wandeler ..... A61G 3/065 180/333
2012/0279789 A1 11/2012 Brill et al.
2013/0008732 A1 1/2013 Richter

FOREIGN PATENT DOCUMENTS

JP 2009284944 A * 12/2009

* cited by examiner

*Primary Examiner* — Kevin Hurley
(74) *Attorney, Agent, or Firm* — Daniel Boudwin; Global Intellectual Property Agency

(57) ABSTRACT

A detachable electric drive unit for a wheelchair is provided. The detachable electric drive unit includes a housing having an interior volume and two guide rails disposed on opposing sides of the housing. Each guide rail includes a channel to receive a wheelchair wheel and has at least two wheels attached to opposing ends of each guide rail. A roller assembly is disposed within the channels of each guide rail. An electric motor is coupled to the roller assembly in each guide rail. The electric motor drives the roller assembly imparting rotational motion to the wheelchair wheels supported within each channel.

9 Claims, 3 Drawing Sheets

DETACHABLE ELECTRIC DRIVE UNIT FOR A WHEELCHAIR

CROSS REFERENCE TO RELATED APPLICATION

This application claims the benefit of U.S. Provisional Application No. 62/081,629 filed on Nov. 19, 2014. The above identified patent application is herein incorporated by reference in its entirety to provide continuity of disclosure.

FIELD OF THE INVENTION

The invention generally relates to wheelchair roller assemblies. More particularly, the present invention relates to a detachable electric drive unit for a wheelchair including a housing and two guide rails that support wheelchair wheels, where an electric motor drives a roller assembly in each guide rail imparting rotational motion to the wheelchair wheels supported within each channel.

BACKGROUND OF THE INVENTION

Manual wheelchairs are designed to be comfortable, lightweight, maneuverable and can be easily folded and stowed away. These salient features come at the cost of the occupant having to propel the wheelchair by manual force or rely on external help to push the wheelchair. It can be difficult for many wheelchair users to propel a manual wheelchair from one location to another. This is particularly true when traversing long distances or propelling a wheelchair over an obstacle. The manual effort required can sometimes lead to exhaustion or frequent breaks. Power wheelchairs on the other hand are very useful when covering long distances or when the occupant is unable to generate the forces required.

Most powered wheelchairs and powered scooters are heavy, complicated, expensive machines. They have small, fat tires and fairly complex joy stick-operated control systems. They generally include two electric motors that may be driven by one or more large lead-acid batteries. While intended for outdoor as well as indoor use, the machines are ill-suited for unpaved surfaces like grass and dirt. Nonetheless, powered wheelchairs and scooters have been a boon to the handicapped and elderly.

The present invention is specifically directed for application to standard manual wheelchairs. Despite the maneuverability and transportability of these manual wheelchairs, powered wheelchairs are far more capable of handling grades, soft surfaces such as grass and off road conditions. There are other devices for converting manual wheelchairs to power wheelchairs, but none provide a detachable electric drive unit having guide rails with a channel to support wheelchair wheels of the present invention. The present invention fulfills the need to enable light weight wheelchairs to be less expensively motorized and, if necessary, provide the option for remote control movement or other similar human interface devices for control without detracting from the appearance, maneuverability and transportability of the wheelchair.

SUMMARY OF THE INVENTION

In view of the foregoing disadvantages inherent in the known types of power drives for wheelchairs now present in the prior art, the present invention provides a detachable electric drive unit wherein the same can be utilized for providing convenience for the user when converting a manual wheelchair to an electric wheelchair.

It is therefore an object of the present invention to provide a new and improved detachable electric drive unit for a wheelchair that has all of the advantages of the prior art and none of the disadvantages.

It is another object of the present invention to provide a detachable electric drive unit comprising a housing having an interior volume and two guide rails disposed on opposing sides of the housing. The guide rails are substantially parallel to one another.

Another object of the present invention is to provide a detachable electric drive unit wherein each guide rail includes a channel to receive a wheelchair wheel. The channel comprises an elongated arm having a hollow interior volume that is configured to receive a wheelchair wheel therein. The elongated arm firmly secures the wheelchair wheel.

Yet another object of the present invention is to provide a detachable electric drive unit further comprising a roller assembly disposed within the channel of each guide rail. The roller assembly includes comprises at least one upper roller and at least one lower roller along a backside of the channel adjacent to the housing.

A further object of the present invention is to provide a detachable electric drive unit with a motor enclosed within the interior volume of the housing. The motor is coupled to the roller assembly in each guide rail and imparts rotational motion to the wheelchair wheels supported therein.

Another object of the present invention is to provide a detachable electric drive unit that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
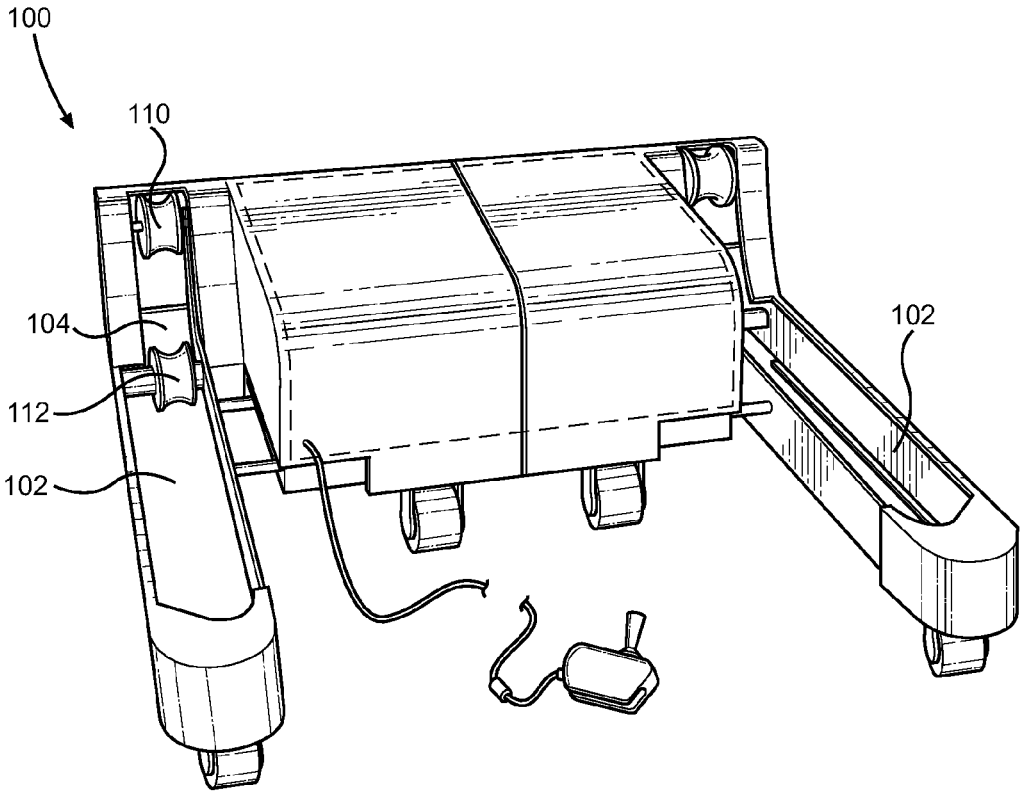
FIG. 1 shows a perspective view the detachable electric drive unit according to one embodiment of the present invention.

Reference is made herein to the attached drawings. Like reference numerals are used throughout the drawings to depict like or similar elements of the detachable electric drive unit. For the purposes of presenting a brief and clear description of the present invention, the preferred embodiment will be discussed as used for converting a manual wheelchair to an electric wheelchair. The figures are intended for representative purposes only and should not be considered to be limiting in any respect.

Figure 3:
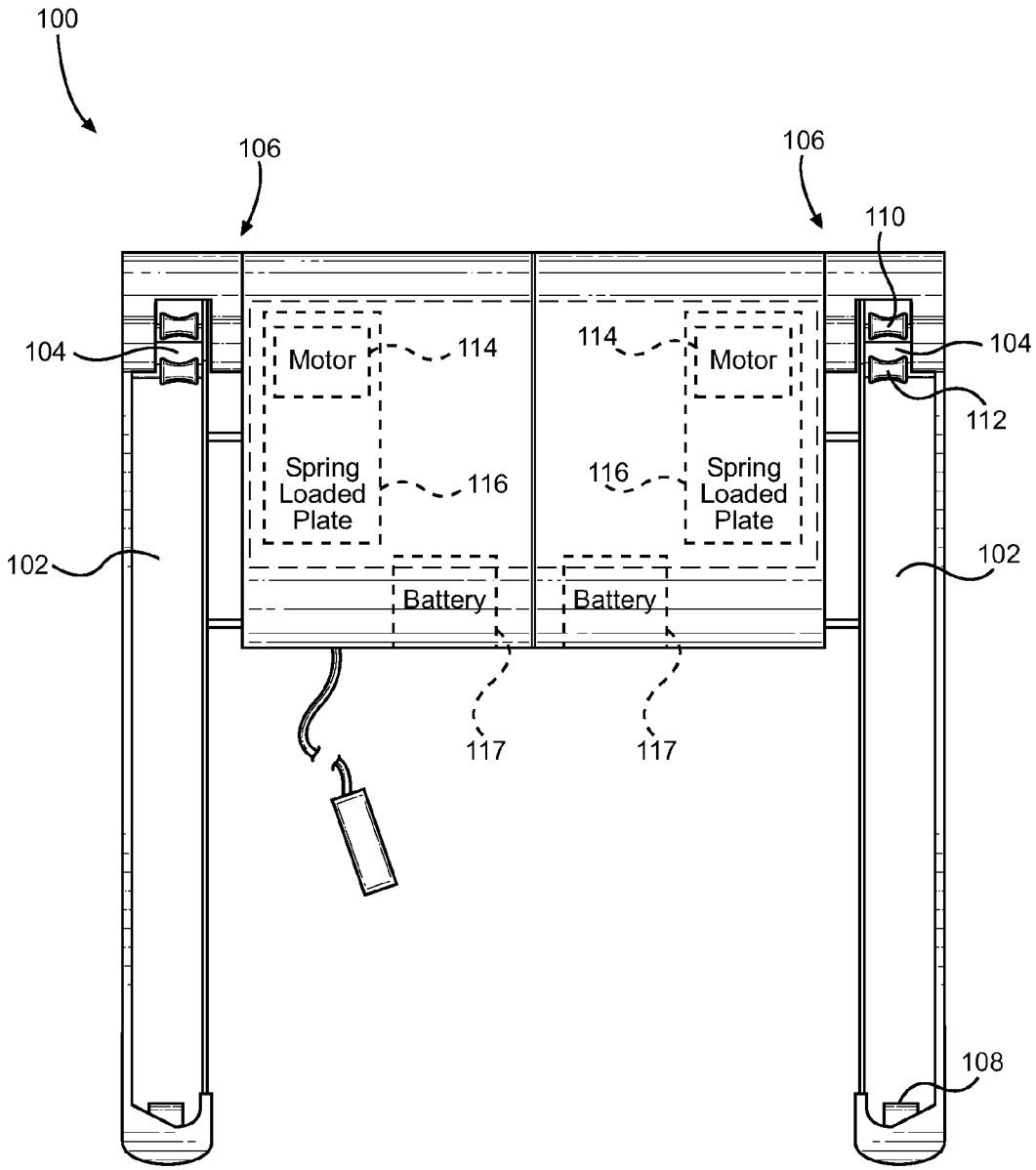
FIG. 3 shows an overhead interior view of the detachable electric drive unit according to one embodiment of the present invention.

Referring now to FIGS. 1 and 3, there are shown perspective views the detachable electric drive unit according to one embodiment of the present invention. The detachable electric drive unit includes a housing 100 having an interior volume and two guide rails 102 disposed on opposing sides of the housing 100. In a preferred embodiment, the housing 100 has multiple removable compartments such that the housing 100 can be expanded to match the width of a wheelchair. Each guide rail 102 includes a channel 104 to receive a wheelchair wheel. The channel 104 includes an elongated arm portion having a hollow interior volume configured to receive a wheelchair wheel. At least two wheels 108 are attached to opposing ends of each guide rail 102. The channel 104 allows the wheelchair wheel to be flush against the floor. In some embodiments, the guide rails 102 are telescopic such that the length can be adjusted to fit wheelchair wheels of different sizes.

The guide rails 102 also provides attachment points for the motor 114 to the roller assembly 106. The motor 114, preferably a worm gear motor, is located within the interior volume of the housing 100. The motor 114 is operably connected to the roller assembly 106 to impart rotational to the upper roller 110 and lower roller 112 in each guide rail channel 104. In this embodiment, the housing 100 and the guide rails 102 are constructed of welded hollow tubes and sheet metal but, for weight and portability considerations, the frame could be constructed using lighter materials. The housing 100 provides a platform, such as the spring loaded plate 116, and various places to connect the various subsystems and components. In one embodiment, the housing 100 directly connects and supports the electrical motor including the batteries 117, a control module of the user interface as well as the drivetrain including the motors.

Figure 2:
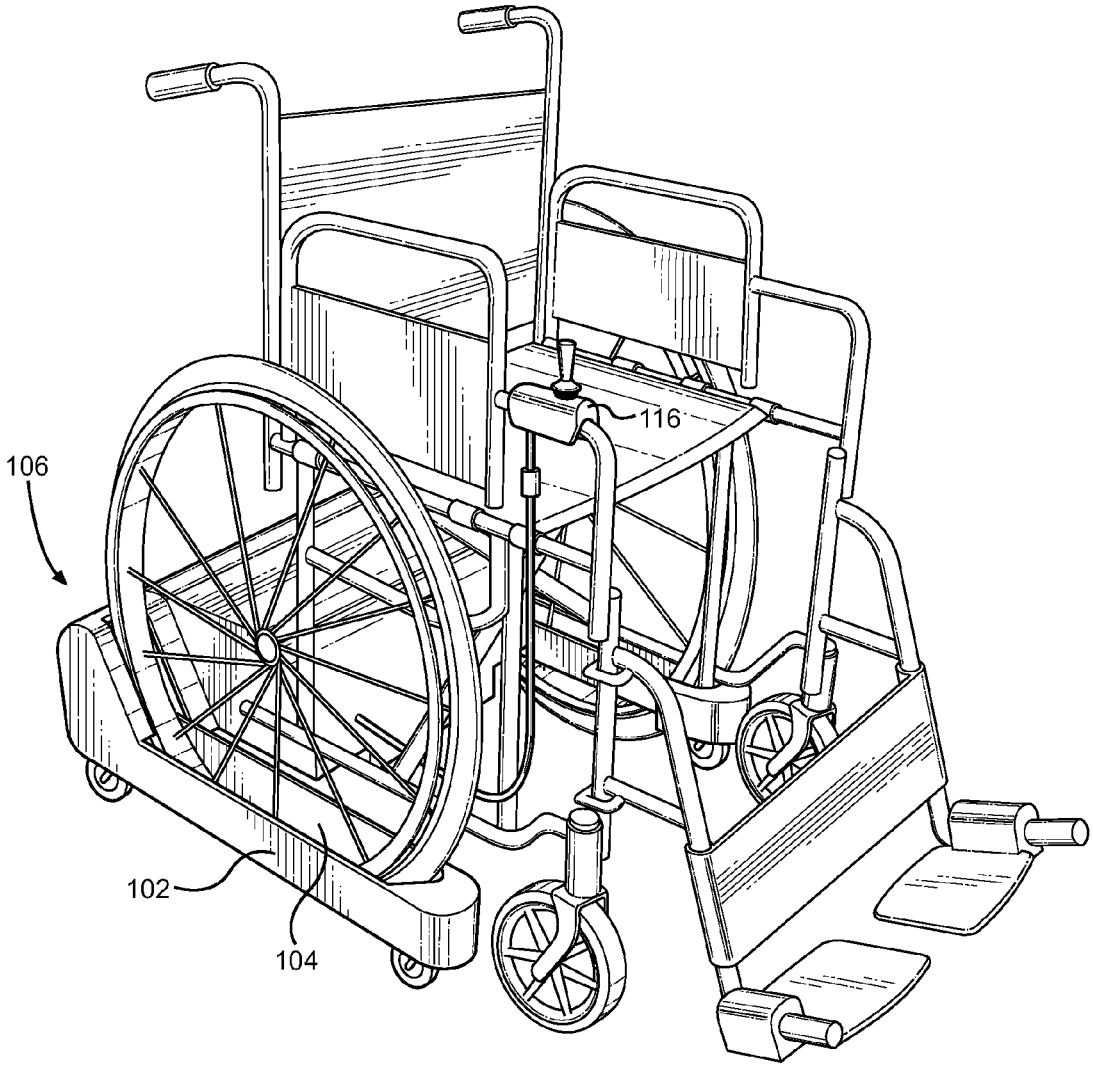
FIG. 2 shows the detachable electric drive unit coupled to a wheelchair according to one embodiment of the present invention.

Referring now to FIG. 2, there is shown an overhead view of the detachable electric drive unit according to one embodiment of the present invention. The guide rails 102 provide a rigid mounting for the wheels and transfers drive force from a motor to the wheelchair for either propulsion or braking through a roller assembly 106. The roller assembly 106 is disposed within the channel 104 of each guide rail 102. The roller assembly 106 comprises at least one upper roller and at least one lower roller along a backside of the channel 104 adjacent to the housing 100. In one embodiment, the upper roller is coupled to the motor and imparts rotational motion to the wheelchair wheel and lower roller supports the wheelchair wheel. The roller assembly 106 is in contact with the wheelchair wheel in each guide rail 102.

In the preferred embodiment, the detachable electric drive unit may be fitted to the intended manual wheelchair to insure that the ground contacts of all wheels form a single line. To accomplish this function, the length of the guide rails 102 can be adjustable via telescopic channels 104 or may be fabricated to snugly fit a standard wheelchair wheel. The guide rails 102 is then rigidly fixed to the wheels once the roller assembly 106 wheels are in line with the wheelchair wheels and the guide rail wheels 108.

The housing 100 may further comprise user interface 116 that transmits the wishes of the wheelchair occupant in the form of inputs to the motor 114. In one embodiment, the user interface 116 may be a controller adapted to receive user instructions. In another embodiment, the interface 116 is a form of a joystick, similar to standard joysticks in use on current power wheelchairs. In the preferred embodiment, the communication between joystick and controller is wireless. The choice of wired versus wireless communication is also a functional decision and has little bearing on the operation of the electric power drive unit.

In one embodiment of the present invention, the remote control may further include a joystick that can either be part of a handheld structure or could be fastened to any part of the wheelchair that can be reached by the occupant. The user interface includes visual cues that prompt the user to orient it such that a forward motion of the joystick will cause a forward motion of the wheelchair. In that fashion, manipulating the joystick in a certain direction will cause a corresponding motion of the wheelchair in the same direction. The velocity of the wheelchair is proportional to the level of motion of the joystick. While a joystick is the preferred embodiment, there are many alternatives that could accomplish the same effect such as a capacitive touch screen, a keyboard, a mouse, a touchpad, a space ball, among a plethora of other input devices.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A detachable electric drive unit for a wheelchair, comprising a housing having an interior volume and two guide rails disposed on opposing sides of the housing, wherein each guide rail includes a channel to receive a wheelchair wheel;

a roller assembly disposed within the channel of each guide rail;

at least two wheels attached to opposing ends of each guide rail;

a motor coupled to the roller assembly in each guide rail, wherein the motor is located in the interior volume of the housing.

2. The detachable drive unit of claim 1, wherein the housing includes at least four wheels.

3. The detachable drive unit of claim 1, wherein the roller assembly comprises at least one upper roller and at least one lower roller along a backside of the channel adjacent to the housing.

4. The detachable drive unit of claim 3, wherein the upper roller is coupled to the motor and imparts rotational motion to the wheelchair wheel.

5. The detachable drive unit of claim 3, wherein the lower roller supports the wheelchair wheel.

6. The detachable drive unit of claim 1, wherein the roller assembly is in contact with the wheelchair wheel in each guide rail.

7. The detachable drive unit of claim 1, wherein the motor is a worm gear motor.

8. The detachable drive unit of claim 1, further comprising a remote control adapted to control the speed of the motor.

9. The detachable drive unit of claim 1, wherein the channel comprises an elongated arm having a hollow interior volume.

* * * * *